United States Patent [19]

Huffnagle

[11] Patent Number: 4,691,105

[45] Date of Patent: Sep. 1, 1987

[54] THERMAL ENERGY PROXIMITY DETECTOR

[75] Inventor: Norman P. Huffnagle, Hennepin, Minn.

[73] Assignee: Honeywell Inc., Minneapolis, Minn.

[21] Appl. No.: 740,798

[22] Filed: Jun. 3, 1985

[51] Int. Cl.[4] ..... G01J 1/28

[52] U.S. Cl. ..... 250/338; 250/342; 102/213

[58] Field of Search ..... 250/342, 338 PY, 349, 250/370 G, 338; 307/358, 354; 340/67, 600; 102/213; 356/4

[56] References Cited

U.S. PATENT DOCUMENTS

| | | | |
|---|---|---|---|
| 3,036,219 | 5/1962 | Thompson | 250/342 |
| 3,455,243 | 7/1969 | Martin | 102/213 |
| 3,727,553 | 4/1973 | Godfrey | 250/342 |
| 4,209,699 | 6/1980 | Pusch | 250/342 |
| 4,227,077 | 10/1980 | Hopson et al. | 250/342 |
| 4,257,703 | 3/1981 | Goodrich | 356/4 |
| 4,470,151 | 9/1984 | Billingsley et al. | 250/342 |
| 4,593,406 | 6/1986 | Stone | 250/491.1 |

FOREIGN PATENT DOCUMENTS

| | | | |
|---|---|---|---|
| 2556086 | 6/1985 | France | 102/213 |

*Primary Examiner*—Carolyn E. Fields
*Assistant Examiner*—Richard Hanig
*Attorney, Agent, or Firm*—Roger W. Jensen

[57] ABSTRACT

A proximity sensor comprising a thermal detector responding to the rate of change of a thermal input and connected to circuitry for performing a control function when the detector output becomes zero, which occurs when a target being approached by the detector fills the field of view of the detector.

2 Claims, 4 Drawing Figures

THERMAL ENERGY PROXIMITY DETECTOR

FIELD OF THE INVENTION

This invention relates to the field of electrical engineering, and particularly to proximity sensors for use in target seeking projectiles.

DESCRIPTION OF THE PRIOR ART

There is a class of uncooled thermal detectors that respond only to changes in incoming thermal energy, not to the absolute value of the incoming energy. A typical example of such a thermal detector material is lithium tantalate ($LiTaO_3$), although this invention is not restricted to this one material.

Prior use of such materials has required the use of optical or opto-mechanical devices to periodically interrupt or chop the incoming thermal energy. The resulting chopped optical signal into the detector gives rise to a corresponding chopped electrical signal out of the detector. This chopped electrical signal is then manipulated in normal fashion to develop intelligence signals for the weapon system to which the thermal detector is attached.

The requirement for optical or opto-mechanical devices to chop the incoming radiation has limited the use of these thermal detectors, and thereby lost the advantages of inherent ruggedization and low cost that these detectors can provide.

SUMMARY OF THE INVENTION

This invention takes advantage of certain well-known relationships in thermal radiation physics, and has combined them with a sensor embodiment in a novel manner to effect a sensor for proximity fuse applications that does not require optical or opto-mechanical chopping of the incoming radiation.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals identify corresponding parts throughout the several views.

DESCRIPTION OF THE PREFERRED EMBODIMENT

Figure 1:
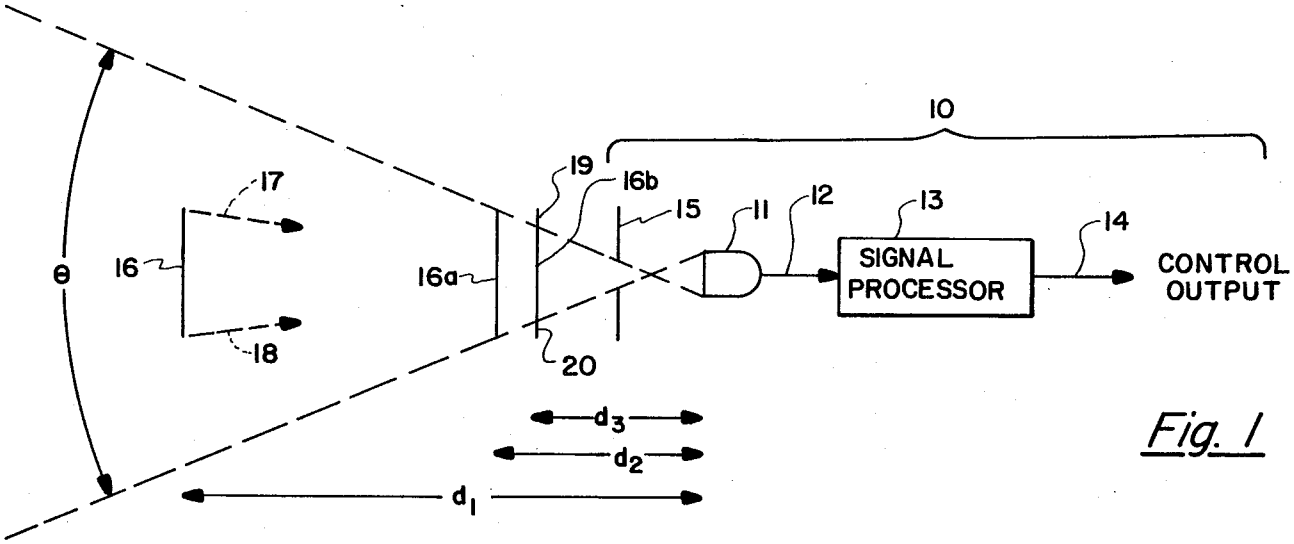
FIG. 1 is a schematic showing of apparatus embodying the invention.

Turning now to the drawing, FIG. 1 shows a sensor 10 including a lithium tantalate detector 11 supplying a signal 12 through a signal processor 13 to give a control output 14. Detector 11 is mounted behind an opaque plate 15 having an aperture which limits the field of view of the detector, as suggested by the angle $\theta$. An infrared target 16 is shown in the field of view of the detector, at a range or distance $d_1$ therefrom. It is evident, as suggested by the broken lines 17 and 18, that radiation from every part of target 16 can reach detector 11.

It is well known that the thermal radiation density sensed from a thermally active target of effectively constant temperature varies inversely with the range squared. What has not been appreciated is that this radiation density gradient can be likened to a time rate of change of energy if the sensor is moved through the gradient. Thus, as the detector moves toward the target, the energy received therefrom has a positive rate of change. Since thermal detectors such as lithium tantalate respond only to the time rate of change of energy, the detector 11 exhibits an output that is proportional to the target temperature, the target size with respect to the sensor field of view, and the speed at which the sensor closes on the target.

Figure 2:
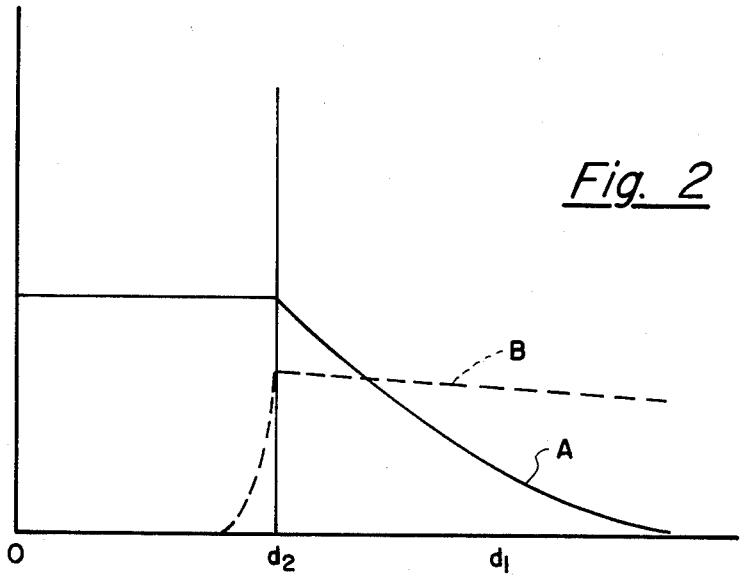
FIG. 2 is a graphical showing of relations underlying the invention.

These relations are shown in FIG. 2, in which the abscissa is range, or distance between detector and target, and the ordinate is relative amplitude. For simplicity, the curves are based on a constant rate of movement of the detector, which results in a second degree curve A of energy reaching the detector, and a linear curve B showing the detector output.

This continues until the detector reaches a distance $d_2$ from the target at which the target completely fills the field of view of the detector, as suggested at **16*a* in FIG. 1. If movement of the detector continues, so that the distance becomes $d_3$, as suggested by the line 16*b* in FIG. 1, it is evident that portions of the target, suggested at 19 and 20** for example, no longer supply energy to the detector, and that these portions become larger and larger as distance further decreases. It may be shown by optical geometry that no further change in detector energization takes place after the distance $d_2$ is reached, regardless of the rate of change of the distance.

These relations are shown in FIG. 2, where curve A has a constant value after distance $d_2$ is reached and curve B drops off sharply at distance $d_2$, quickly becoming zero.

Figure 3:
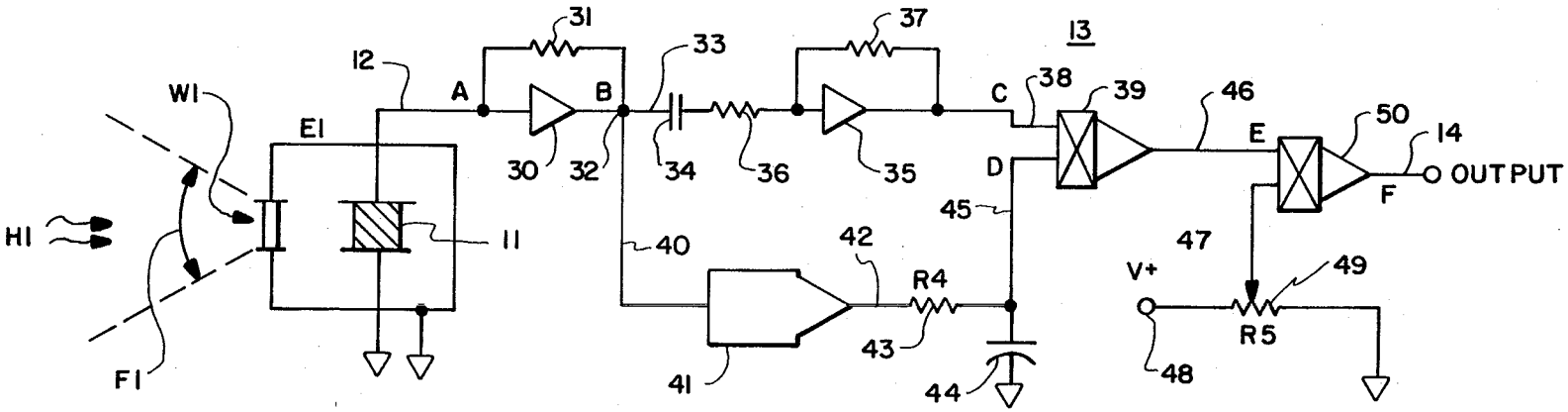
FIG. 3 is a wiring schematic of apparatus shown in FIG. 1.

Attention is now directed to FIG. 3, which shows signal processor 13 in more detail. The radiation absorbed in detector 11 results in a current which flows into an amplifier 30 having a feedback resistor 31 which sets the transimpedence gain of the amplifier so that the input current is converted to an output voltage at a terminal 32.

This voltage is split between two paths. The first path leads through conductor 33 and capacitor 34 to an amplifier 35 having input and feedback resistors 36 and 37 respectively which set the voltage gain ratio. The further amplified voltage is applied as one input 38 to a threshold comparator 39.

The second path from terminal 32 leads through conductor 40 to an RMS computer 41, so that the output 42 of the computer is the RMS value of the input voltage. The output 42 is fed through a resistor 43 to a capacitor 44 which acts as a storage and averaging device. The averaged voltage on capacitor 44 is applied as a second input 45 to comparator 39.

If there is sufficient difference between the comparator output 46 and a comparison voltage 47 from a source 48, preset by voltage divider 49, the output 14 of a second threshold comparator 50 chang es state, again in a well known manner.

The voltage 47 is selected by divider 49 so that the output 14 goes from a low voltage state, say zero volts, to a high voltage state, say V+, when the suspect target size has grown to fully fill the detector's field of view. This output is called the fusing indication output, and may be used to initiate an explosive device.

Figure 4:
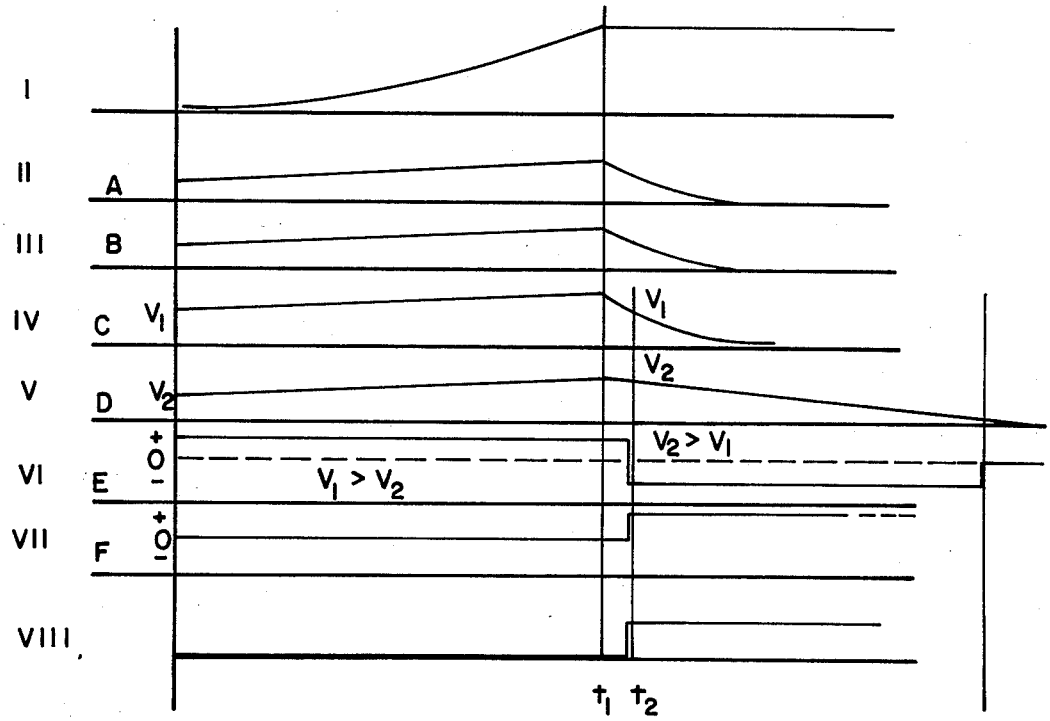
FIG. 4 is a graphical showing of relations underlying FIG. 3.
Figure 4:
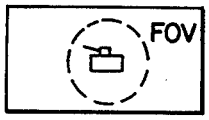

FIG. 4 is illustrative of the operation of signal processor 13, and assumes constant detector speed and a noise-free target. The curves in this figure have a common abscissa of time. Curve I shows how the radiation reaching detector 11 increases to a maximum value reached when the target fills the field of view of the detector, at time $t_1$. Curve II shows the detector output at point A on FIG. 3. Curve III shows the output from amplifier 30, at point B. Curve IV shows the first input $V_1$ to comparator 39, at point C. Curve V shows the second input $V_2$ to comparator 39 at point D. Curve VI shows the output of comparator 39 at point E.

It will be evident that $V_1$ is greater than Vhd 2 up to a point $t_2$. When this point is reached, the comparator output reverses, causing reversal of the output of comparator 50 as shown in curve VII.

The actual distance between a target and a detector, at time $t_1$, is determined by the angle $\theta$ in the design of the equipment. It will be appreciated that, if desired, plate 15 may provide a selection of apertures of different sizes, or that lenses of different focal length may be placed in the aperture of plate 15, to predetermine time $t_1$, for expected targets of different sizes.

From the above it will be evident that I have invented a proximity detector adapated to use a detector such as lithium tantalate without cooling and without optical or opto-mechanical chopping of the incoming thermal energy, by use of the interruption of the rate of change of the optical signal which inherently occurs when an approaching target fully fills the detector field of view.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

The embodiments of the invention in which an exclusive property or right is claimed are defined as follows:

1. A detector of thermal energy giving an output which is determined by the rate of change of the energy received by said detector, and which is independent of the absolute value of that energy comprising:

means establishing a field of view for said detector such that as the distance between said detector and a source of thermal energy decreases, the source occupies an increasingly large portion of the field, and the energization of said detector increases until the source fills the entire field of view, whereupon the energization of said detector has no further effective rate of change, so that the output of the detector becomes zero;

and output means connected to the detector for giving a signal when the detector output becomes zero.

2. Apparatus as claimed in claim 1 further characterized by said detector comprising lithium tantalate ($LiTaO_3$).

* * * * *